US008584606B2

(12) United States Patent
Mack et al.

(10) Patent No.: US 8,584,606 B2
(45) Date of Patent: Nov. 19, 2013

(54) HOOP RETAINING DEVICE

(75) Inventors: Charles H. Mack, West Bend, WI (US); Jesse C. Mack, Slinger, WI (US)

(73) Assignee: Midwest Products, Inc., Germantown, WI (US)

( * ) Notice: Subject to any disclaimer, the term of this patent is extended or adjusted under 35 U.S.C. 154(b) by 718 days.

(21) Appl. No.: 12/804,559

(22) Filed: Jul. 23, 2010

(65) Prior Publication Data

US 2012/0017814 A1 Jan. 26, 2012

(51) Int. Cl.
*D05C 7/04* (2006.01)

(52) U.S. Cl.
USPC ..... 112/103

(58) Field of Classification Search
USPC ..... 112/102, 103, 470.6, 470.09, 470.14, 112/470.18
See application file for complete search history.

(56) References Cited

U.S. PATENT DOCUMENTS

| | | | | |
|---|---|---|---|---|
| 5,433,158 | A | 7/1995 | Moore, III | |
| 5,842,430 | A | 12/1998 | Mack | |
| 5,934,210 | A | 8/1999 | Lucchese | |
| 5,967,067 | A | 10/1999 | Guenther | |
| 5,970,895 | A | 10/1999 | Mack | |
| 5,992,339 | A | 11/1999 | Mack | |
| 6,216,617 | B1 | 4/2001 | Burt, Jr. | |
| 7,607,399 | B2 | 10/2009 | Mack et al. | |
| 7,918,169 | B2 * | 4/2011 | Mack et al. | 112/103 |
| 7,966,957 | B2 * | 6/2011 | Mack et al. | 112/103 |

* cited by examiner

*Primary Examiner* — Tejash Patel
(74) *Attorney, Agent, or Firm* — Ryan Kromholz & Manion, S.C.

(57) ABSTRACT

A hooping device for use with an embroidery machine to hold an item or material to be embroidered between upper and lower hooping members, with the hooping members being secured to one another by use of magnetic force is disclosed. The magnets provide a solid, secure mating arrangement between the upper and lower hooping members without the need to adjust the hooping member for different thicknesses of material. The hooping device includes a retaining mechanism to prevent the hooping members from mating prematurely.

19 Claims, 10 Drawing Sheets

HOOP RETAINING DEVICE

BACKGROUND OF THE INVENTION

The present invention relates to the field of embroidery and monogramming and more specifically to a retaining device, which secures a lower magnetic hooping member in a hooping device during the preparation or "hooping" of an item to be embroidered.

In the embroidery industry "hoop" or "hoops" are referred to by many different terms, like frame, clamp, fabric holding device, fabric retaining device and fabric mounting frame. The definition of each of these terms is intended to apply to all of these terms to give these terms their broadest meaning individually and collectively as they are used interchangeably herein. In an instance where the term or terms have more than one meaning, all meanings will apply.

Various types of hoops and frames for holding an item to be embroidered are commonplace for both home embroidery and commercial embroidery machines. Generally, embroidery hoops comprise upper and lower hoops or clamping members that mate with one another. Cloth to be embroidered is placed between the clamping members, usually with a backing material also placed between the lower hooping member and the item to be embroidered. These types of hoops tightly pinch the material between the vertical sides of the upper and lower hooping members when the operator applies pressure to the upper hooping member to mate with the lower hooping member. Because of this, the lower hooping member needs to be adjusted for any change in thickness of the item to be hooped. There are also hoops that employ magnetic force, similar to the hoops of U.S. Pat. No. 7,607,399, to mate the upper and lower hooping members. However, these types of hoops create a potential problem during the mating of the upper hooping member to the lower hooping member. The magnetic attraction of the two hooping members will cause the lower hooping member to prematurely "jump" and mate with the upper hooping member. In other words, magnetic type hooping members can move before the two members are in contact with each other. This creates alignment and distortion problems of the item to be embroidered because the item to be embroidered can be moved when the lower hooping member "jumps."

Prior art hooping devices used to hold and align magnetic hooping members for application to an item to be embroidered do not have any way to secure the lower hooping member so that it does not "jump" and distort the item to be embroidered before the upper and lower members properly mate. Therefore, there is a need for magnetic hooping devices to include a hooping member retaining mechanism to prevent the lower hooping member from "jumping" and mating with the upper hooping member when the upper hooping member is being lowered.

The present invention provides a retaining mechanism used with hooping devices or fixtures on a base plate or a framing board to retain the lower hooping member until the upper hooping member comes in contact with it. Then the retaining mechanism will automatically release the lower hooping member from the hooping device, or the operator will manually release the lower hooping member.

These and other features of the device will become evident with respect to the drawings and the detailed description.

DETAILED DESCRIPTION OF THE DRAWINGS

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
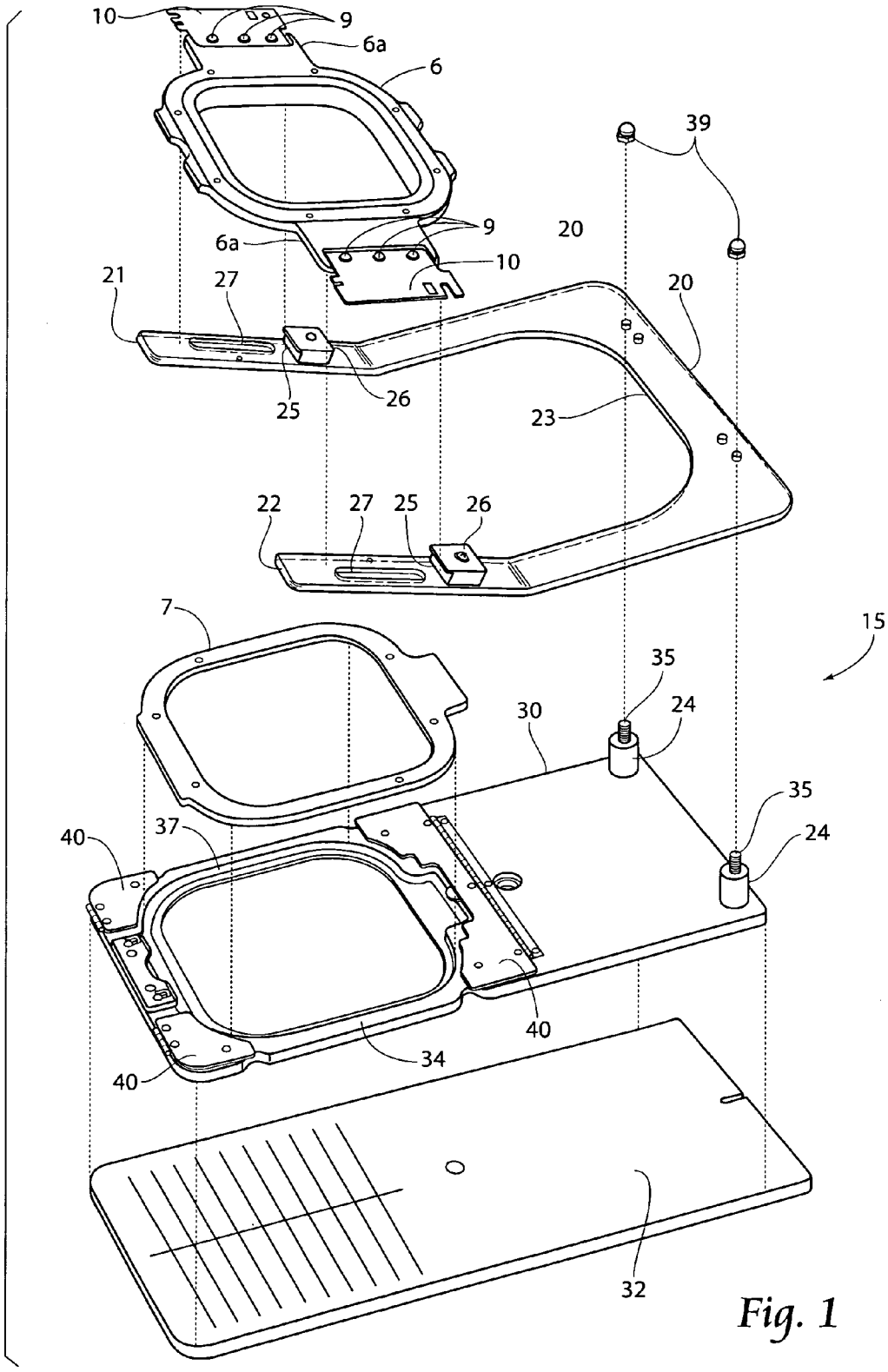
FIG. 1 is an exploded view of the hooping device.

As seen in FIG. 1, a tubular hooping device 15 includes a flexible aligning arm 20 mounted to a base plate 30. The base plate 30 in turn rests upon a hooping board 32. The aligning arm 20, the base plate 30, and the hooping board 32. Furthermore, the base plate 30 has a recess 37 formed into its distal end 34. The recess 37 is shaped so as to receive the lower hooping member 7.

When embroidering, some garments do not provide an adequate embroidery surface so it is the industry practice to place a piece of backing material behind the particular portion of a garment that is to be embroidered. The backing material serves to strengthen and stabilize the fabric being embroidered. In order to ensure that the backing material is located behind a particular portion of a garment to be embroidered, at least one location means 40 is provided on the distal end of the base plate 30, immediately adjacent the keyed recess 37. In this embodiment, the location means 40 comprises a pair of plastic plates located at the distal end of the base plate and hinged therewith and a single plastic plate located at the proximal side of the base plate and hinged therewith. The location means 40 also employs magnetic attraction to ensure closure. The magnetic means may be located on the plastic plates or the base plate so long as the magnetic force generated between the plates and the base is sufficient to maintain the backing material in its desired position.

The aligning arm 20 illustrated in FIG. 1 is designed to accurately align the upper hooping member 6 with the lower hooping member 7. The aligning arm is comprised of a first finger 21 and a second finger 22 connected at their proximate ends by a web 23. The aligning arm 20 is supported above the base plate 30 at the web 23 upon a spacer 24. Nuts 39 are threaded upon bolts 35 to secure the aligning arm 20, spacer 24, and base plate 30 together. In the embodiment of FIG. 1, it is preferred to fabricate the aligning arm 20 from a polycarbonate material, though it is to be understood that any material possessing similar structural characteristics could be employed.

Locating and aligning mechanisms for repeatedly and accurately positioning the upper hooping member 6 upon the distal end of the fingers 21 and 22 of the aligning arm 20 are also illustrated in FIG. 1. The mechanisms consist of a pair of positioning blocks 26, one mounted on each of the fingers 21 and 22 and a pair of grooves 27 located distal to the positioning blocks 26. The positioning blocks 26 form a slot 25 on each finger 21 and 22 capable of receiving an edge **6*a* of the upper hooping member 6. The finger grooves 27 are located on the fingers 21 and 22 so as to allow a space for the attachment nuts 9, which are used to secure the mounting arms 10 to the upper hooping member 6**.

The complementary action of the slots 25 and the upper hooping member edge **6*a* serve to positively locate the upper hooping member 6 upon the fingers 21 and 22 of the aligning arm 20**. Other upper hooping members will require different, yet equivalent, positioning structures. Another equivalent positioning structure may comprise one or more recesses formed in the bottom surface of the upper hooping member and one or more plates mounted on the aligning arms and positioned to receive the recesses. Although the general structure of all upper hooping members utilized in embroidery machines are somewhat similar, it should be noted and appreciated that different embroidery machine manufacturers have different hoop designs and that different positioning structures and different aligning arms may be utilized without deviating from the present invention.

Figure 2:
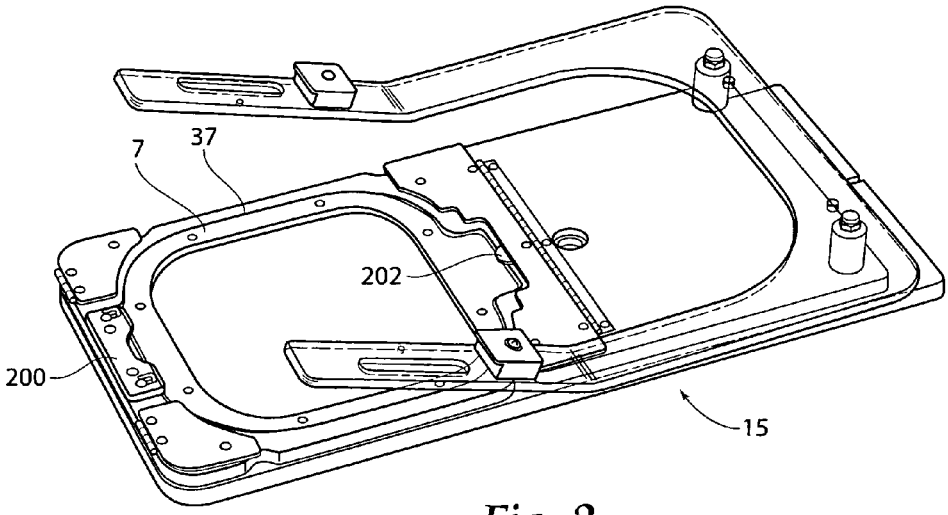
FIG. 2 is a perspective view of the preferred embodiment of the retaining mechanism retaining the lower hooping member in the hooping device.

FIG. 2 depicts the hooping device 15 wherein the lower hooping member 7 is being held in place in the recess 37 by the retaining mechanism 200 and the stationary retaining member 202.

Figure 3A:
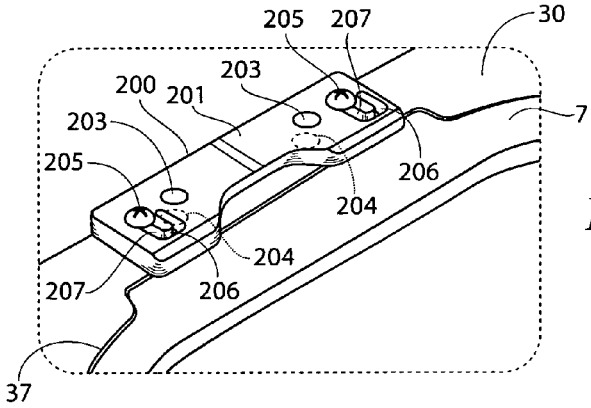
FIG. 3A is a partial perspective view showing the preferred embodiment of the retaining mechanism retaining one side of the lower hooping member.

FIG. 3A shows the retaining mechanism 200 in the engaged position fully retaining the lower hooping member 7. A portion or edge of the movable retaining member 201 is located over the lower hooping member 7 thereby retaining it. The attachment screws 205 secure the movable retaining member 201 to the base plate 30 but still allow the movable retaining member 201 to move slideably along the engagement slots 206. In FIG. 3A the movable retaining member biasing magnets 203 interact with the base plate biasing magnets 204 to always return the movable retaining member 201 to the fully engaged position after being displaced either by the operator or after the upper hooping member 6 FIG. 5 mates with the lower hooping member 7 and they depart from the base plate 30.

Figure 3B:
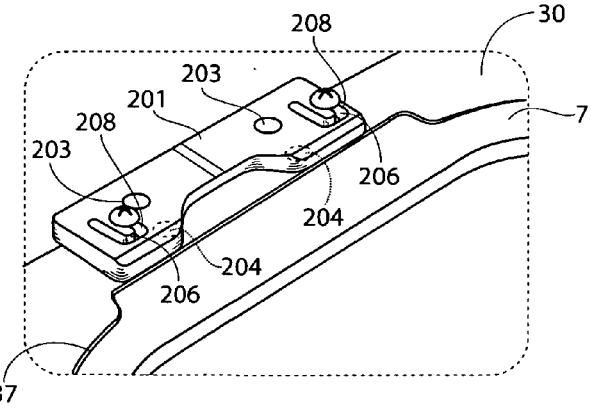
FIG. 3B is a partial perspective view showing the preferred embodiment of the retaining mechanism in the disengaged position.

The shape of the engagement slots 206 also allows the operator to disengage the movable retaining member 201. The engagement slots 206 are u-shaped, wherein one side of the "U" is longer than the other. The different length sides translate into more or less travel along the attachment screws 205. When the attachment screws 205 are located within the longer side 207 of the engagement slots 206, as in FIG. 3A, the movable retaining member 201 will extend over the recess 37 and the lower hooping member 7. When the attachment screws 205 are located within the shorter side 208 of the engagement slots 206, as in FIG. 3B, the movable retaining member biasing magnets 203 are prevented from fully aligning with the base plate biasing magnets 204 and the movable retaining member 201 will be prohibited from extending over the recess 37 and the lower hooping member 7. This disengaged position allows for easier hooping of items that do not require the lower hooping member 7 to be retained, as with very thick items.

Figure 4:
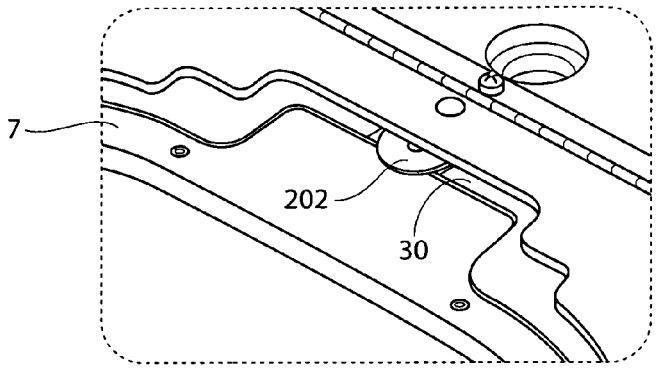
FIG. 4 shows the stationary retaining member, located opposite to the retaining mechanism, retaining one side of the lower hooping member.

FIG. 4 shows the stationary retaining member 202, attached to the base plate 30, fully retaining the lower hooping member 7. This retaining functionality could be attained in many different ways as it is only required to remain stationary and retain the lower hooping member 7.

Figure 5:
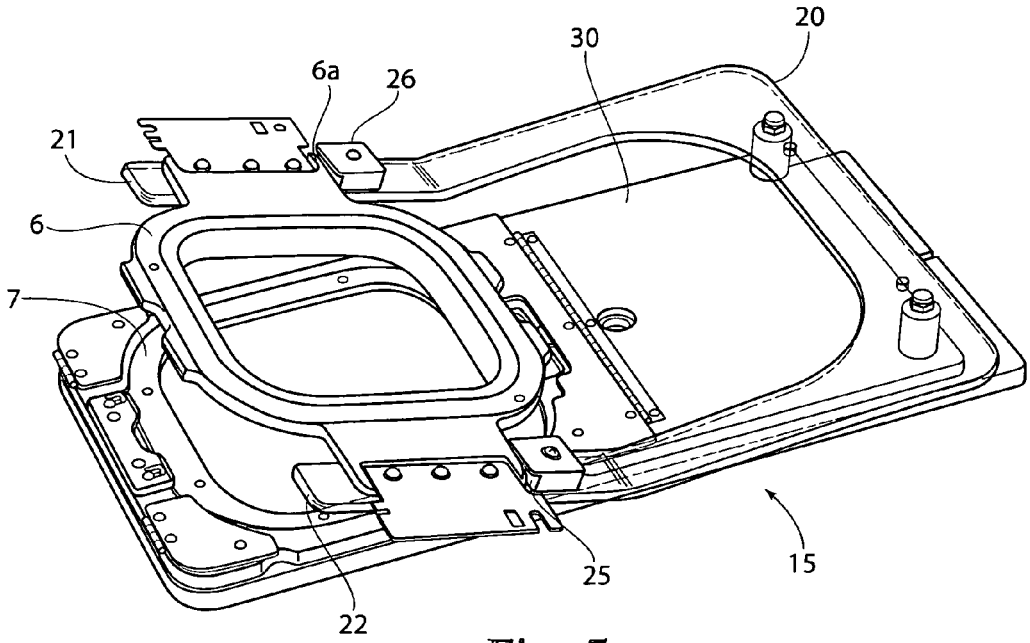
FIG. 5 shows the hooping device in the pre-operation position wherein the retaining mechanism is in the engaged position and retaining the lower hooping member.

FIG. 5 shows the hooping device 15 in the pre-operative position with the upper hooping member 6 positioned on top of the first finger 21 and the second finger 22 of the aligning arm 20 with the upper hooping-member edge **6*a* located in the slot 25 of the positioning blocks 26**.

Figure 6A:
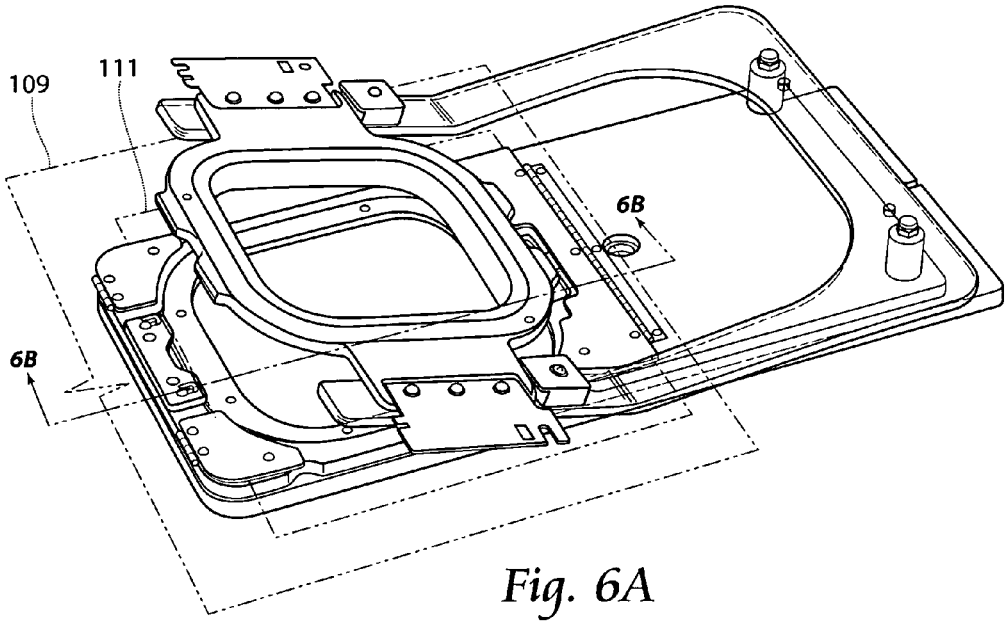
FIG. 6A is a perspective view of the hooping device in the pre-operation position wherein the retaining mechanism is in the engaged position and retaining the lower hooping member and the embroidery backing material and the fabric to be embroidered are in position.
Figure 6B:
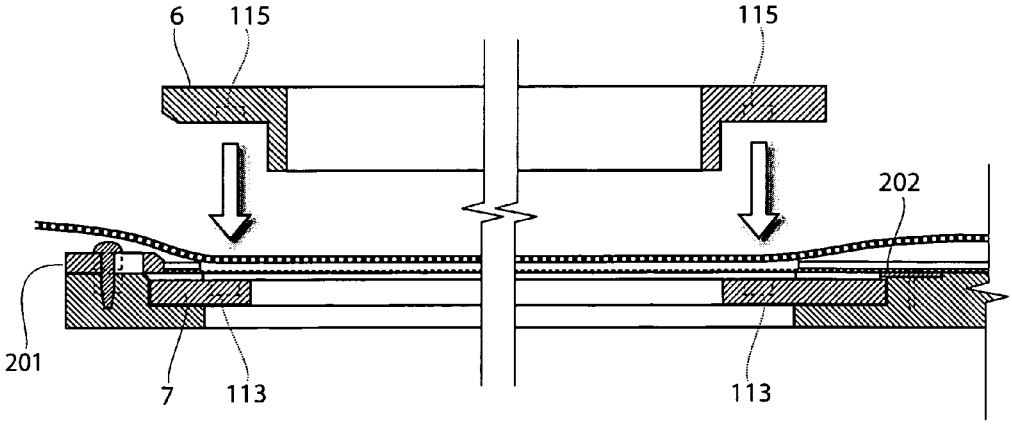
FIG. 6B is a perspective cut away view of the hooping device along line 6B in FIG. 6A as the upper hooping member is being lowered.

FIG. 6A shows the embroidery backing material 111 and the item to be embroidered 109 in their respective embroidery positions. In FIG. 6B a cut away view of FIG. 6A is pictured showing the lowering of the upper hooping member 6 onto the lower hooping member 7. As the upper hooping member 6 is lowered the upper hoop magnets 115 are attracted to the oppositely charged magnets of the lower hooping member 113. In alternative embodiments, one of the hooping members may contain a material to attract the magnets of the other hooping member instead of containing oppositely charged magnets. Furthermore, as the upper hooping member 6 is lowered, the magnetic force that wants to mate the two hooping members is overcome by the engaged retaining mechanism 201 and the stationary retaining member 202.

Figure 7A:
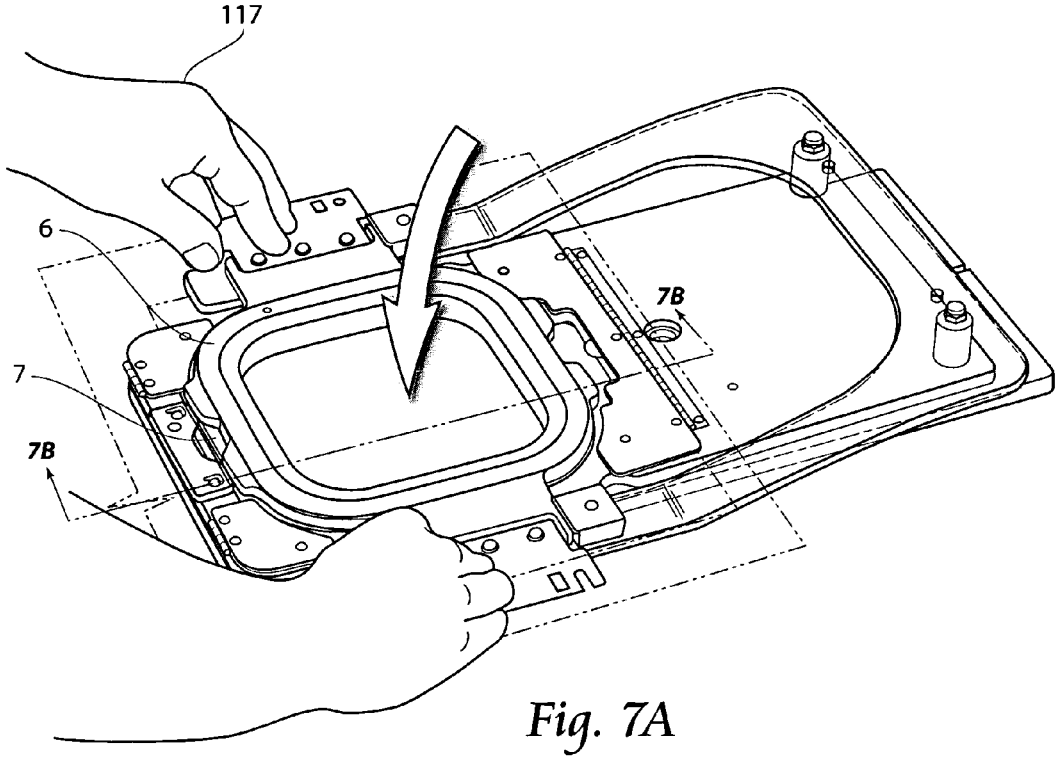
FIG. 7A is a perspective view of an operator manually lowering the upper hooping member and mating it with the lower hooping member.
Figure 7B:
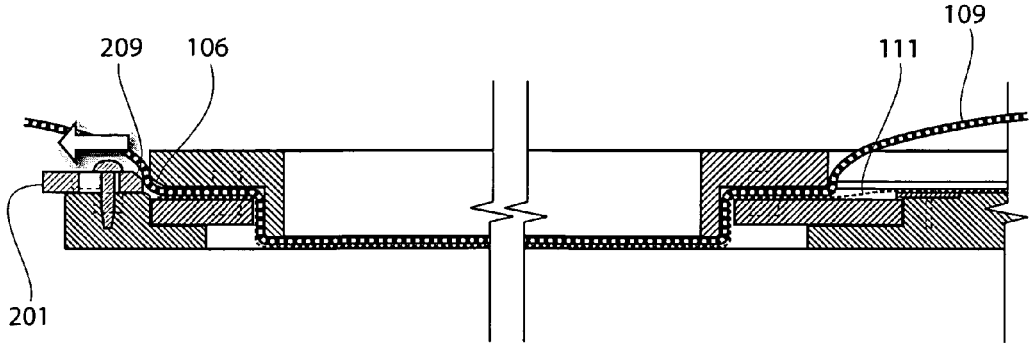
FIG. 7B is a perspective cut away view of the hooping device along line 7B in FIG. 7A as the upper hooping member is fully mated with the lower hooping member.

FIG. 7A shows an operator 117 pushing the upper hooping member 6 downward to mate with the lower hooping member 7. FIG. 7B shows a cut away view of FIG. 7A; wherein both the fabric to be embroidered 109 and the embroidery backing material 111 are positioned between the upper hooping member 6 and the lower hooping member 7. Additionally, it is shown how the upper hoop chamfered edge 106 interacts with the movable retaining member chamfered edge 209 as the two hooping members come together. The upper hoop chamfered edge 106 applies a force onto the movable retaining member chamfered edge 209 thereby forcing the movable retaining member 201 to slide away from the lower hooping member 7 allowing both hooping members the freedom to be raised together as seen in FIG. 8A and FIG. 8B.

Figure 8A:
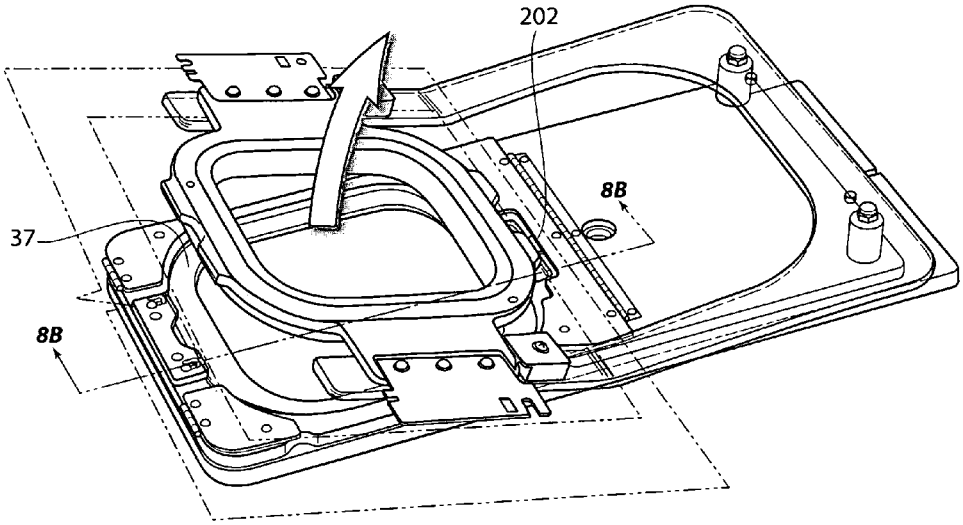
FIG. 8A is a perspective view of the hooping device as the mated hooping members are raised with the embroidery backing material and the fabric to be embroidered positioned between them.
Figure 8B:
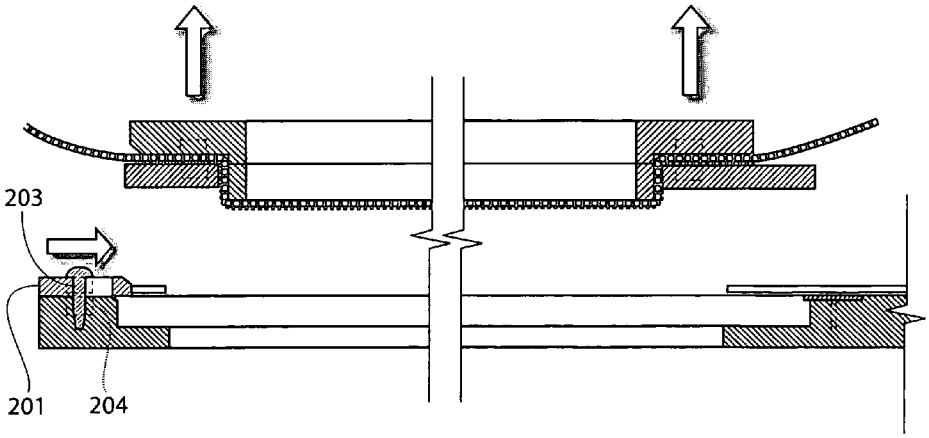
FIG. 8B is a perspective cut away view of the hooping device along line 8B in FIG. 8A as the mated hooping members are raised.

FIG. 8A shows the movement of the two mated hoops as they are removed together. This removal action allows the portion of the lower hooping member, located underneath the stationary retaining member 202 to be removed from the recess 37. Furthermore, in FIG. 8B it is shown how the movable retaining member 201 repositions itself into the original engaged position because of the biasing affect of the movable retaining member biasing magnets 203 aligning with the base plate biasing magnets 204.

Figure 9A:
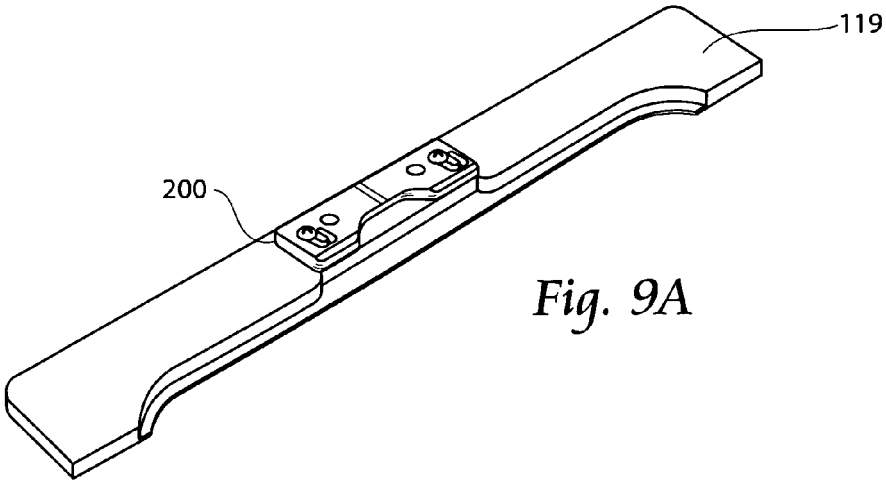
FIG. 9A is a perspective view of a larger hoop locating member employing the hoop retaining mechanism.
Figure 9B:
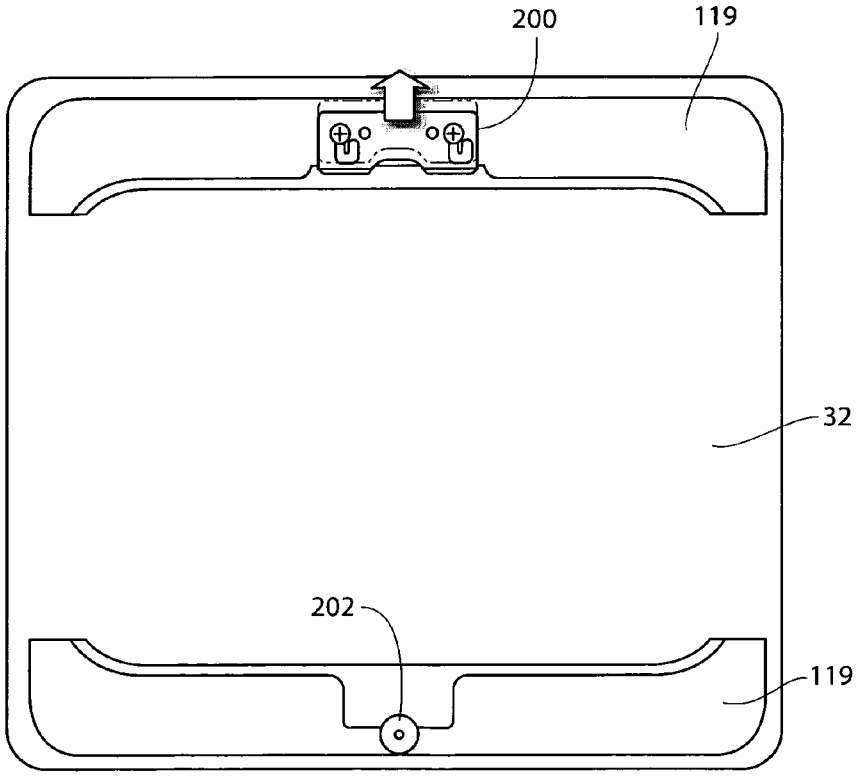
FIG. 9B is a top view of two hoop locating members on a hooping board. One of the hoop locating members contains the hoop retaining mechanism and the other has the stationary retaining member.

FIG. 9A and FIG. 9B show the preferred embodiment of the retaining mechanism 200 and stationary retaining member 202 in use on larger hoop locating members 119 and situated on a hooping board 32.

Figure 10:
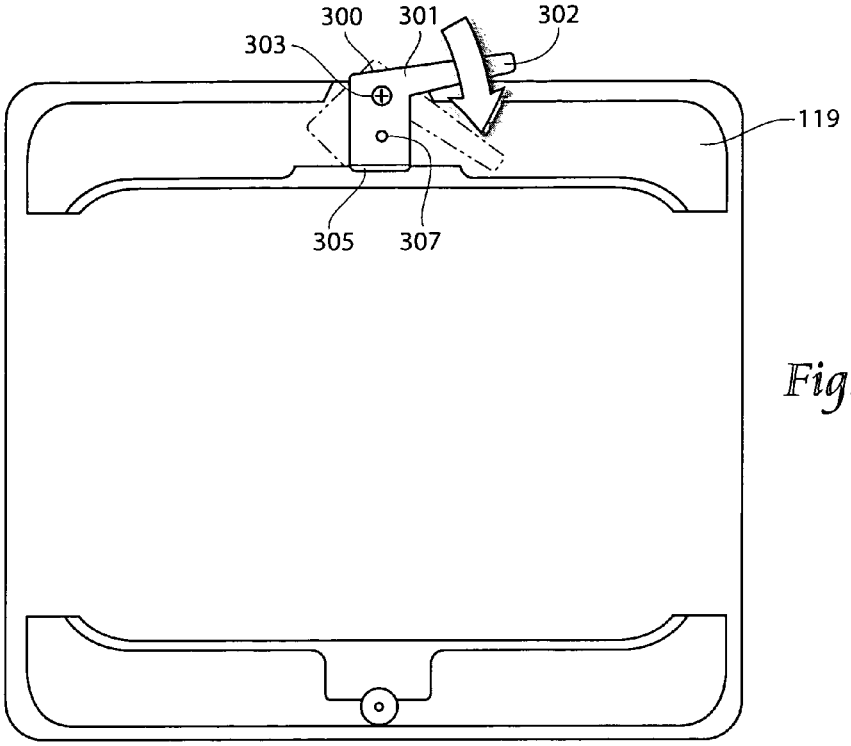
FIG. 10 is a top view of another embodiment of the hoop retaining mechanism on a hoop locating member.

FIG. 10 shows another embodiment of a retaining mechanism 300 installed on a larger hoop locating member 119. In this embodiment of the retaining mechanism 300 the movable retaining member 301 is rotated around the attachment screw 303 by pushing or pulling the movable retaining member handle 302. A biasing mechanism may be employed to return the movable retaining member back to the original engaged position. In FIG. 10 the use of a pair of magnets 307 as a biasing mechanism is shown. Additionally, the movable retaining member 301 will have a chamfered engagement edge 305 to complement the chamfered engagement edge of the upper hooping member (not pictured but similar to 106 on FIG. 7B) which will allow the upper hooping member (not pictured here but similar to 6 FIG. 6A) to fully mate with the lower hooping member (not pictured here but similar to 7 FIG. 2).

Figure 11:
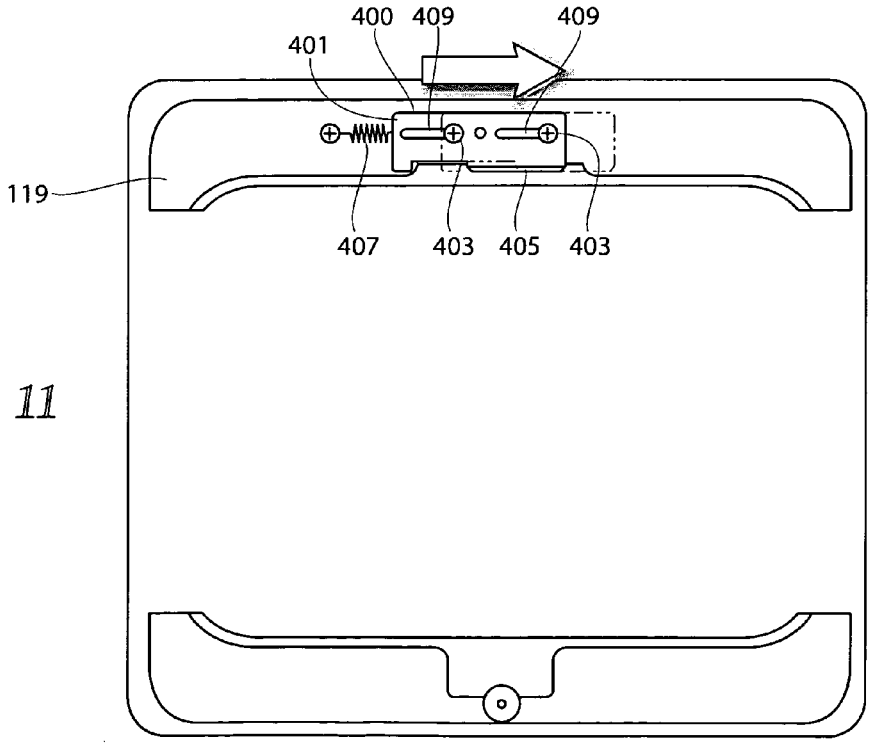
FIG. 11 is a top view of another embodiment of the hoop retaining mechanism on a hoop locating member.

FIG. 11 shows another embodiment, wherein the retaining mechanism 400 can be disengaged by sliding it to one side. The movable retaining member 401 has two slots 409 through which attachment screws 403 are placed to secure the movable retaining member 401 to the hoop locating member 119. The design also incorporates a chamfered engagement edge 405 on the retaining mechanism 401 to complement the chamfered engagement edge of the upper hooping member (not pictured but similar to 106 on FIG. 7B) which will allow the upper hooping member (not pictured here but similar to 6 FIG. 6A) to fully mate with the lower hooping member (not pictured here but similar to 7 FIG. 2).

To use the retaining mechanism of FIG. 11 the operator slides the movable retaining member 401 away from the engaged position until no part of the movable retaining member 401 over hangs the area where the lower hooping member (not pictured here but similar to 7 FIG. 2) will be placed. The operator then installs the lower hooping member (not pictured here but similar to 7 FIG. 2) and releases the movable retaining member 401 allowing the biasing mechanism 407 to place the movable retaining member 401 into the original engaged position wherein part of the movable retaining member 401 overhangs the lower hooping member (not pictured here but similar to 7 FIG. 2). If no biasing mechanism is used the operator manually slides the retaining mechanism 401 back to the original engaged position.

Figure 12:
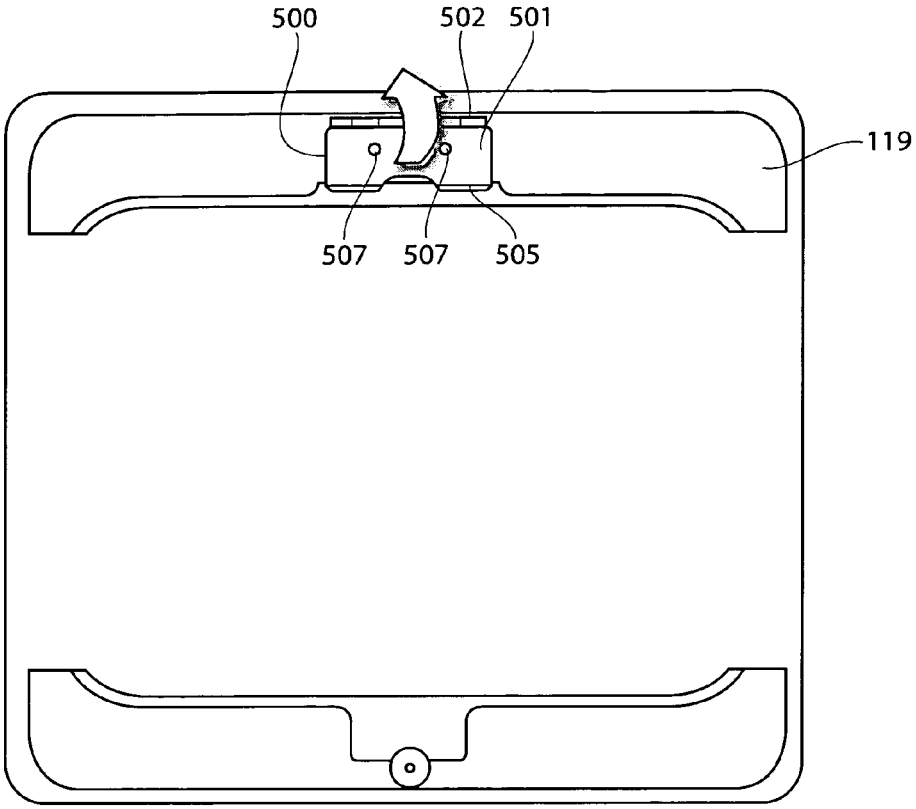
FIG. 12 is a top view of another embodiment of the hoop retaining mechanism on a hoop locating member.

FIG. 12 shows an additional retaining mechanism embodiment 500. In this embodiment the movable retaining member 501 is attached to the hoop locating member 119 by a hinge 502. In the engaged position a portion of the movable retaining member 501 will hang over the lower hooping member (not pictured here but similar to 7 FIG. 2). Through the use of magnets 507 located in the movable retaining member 501 and the hoop locating member 119 the lower hooping member (not pictured here but similar to 7 FIG. 2) will be securely held in place. A chamfered engagement edge 505 on the retaining mechanism 501 complements the chamfered engagement edge of the upper hooping member (not pictured but similar to 106 on FIG. 7B) which will allow the upper hooping member (not pictured here but similar to 6 FIG. 6A) to fully mate with the lower hooping member (not pictured here but similar to 7 FIG. 2) prior to the lower hooping member (not pictured here but similar to 7 FIG. 2) being released.

To use the retaining mechanism of FIG. 12 the operator lifts up on the edge, opposite the hinge, of the movable retaining member 501 radially upward from the engaged position until no part of the movable retaining member 501 hangs over the area where the lower hooping member (not pictured here but similar to 7 FIG. 2) will be placed. The operator then installs the lower hooping member (not pictured here but similar to 7 FIG. 2) and places the movable retaining member 501 back into the engaged position thereby securing the lower hooping member (not pictured here but similar to 7 FIG. 2) with the magnets 507.

Figure 13:
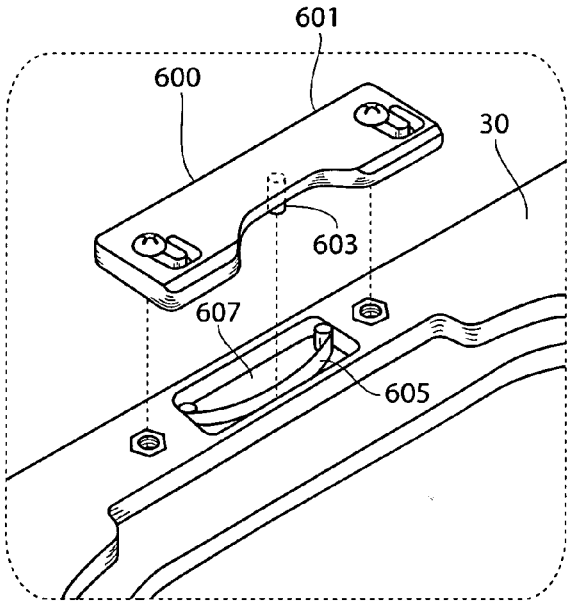
FIG. 13 is a perspective view of another embodiment of a hoop retaining mechanism on a hoop locating member.

FIG. 13 shows an alternative biasing means for a retaining mechanism 600. A single leaf type spring 605 is inserted inside a pocket 607 of the base plate 30. The leaf spring 605 interacts with a peg 603 extending downward from the moveable retaining member 601.

Figure 14:
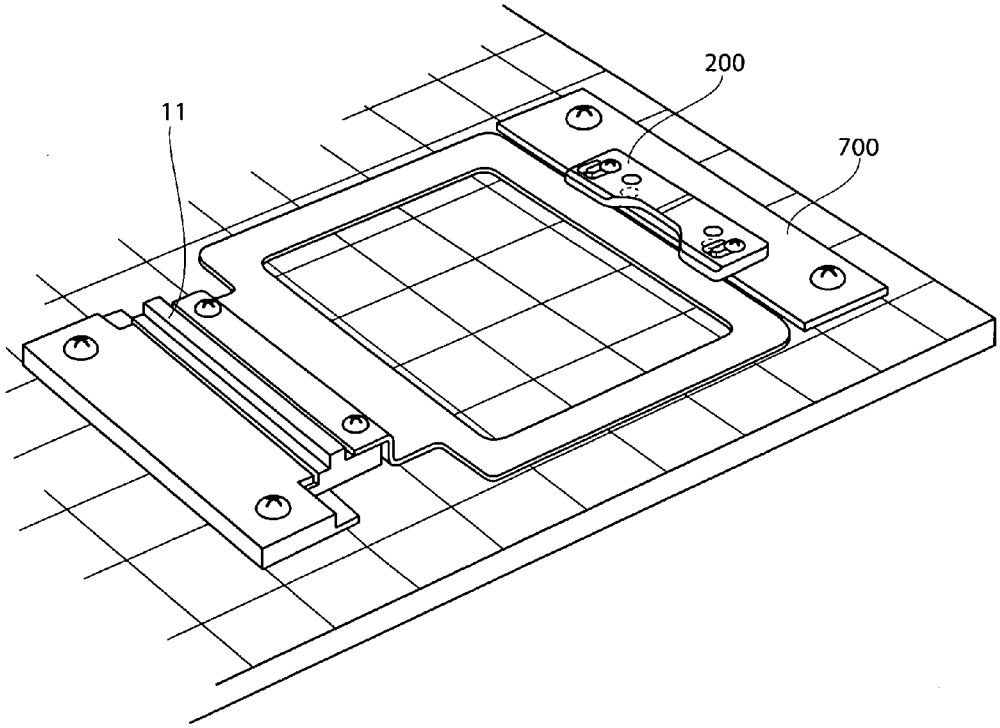
FIG. 14 is a perspective view of another hooping device using a transferable retaining mechanism.

Because hooping devices are used in both commercial and residential settings different types of hooping devices exist. FIG. 14 shows an alternative embodiment of the hooping device using the movable retaining mechanism 200 attached to a transferable bracket mechanism 700 as a means to secure a lower hooping member positioned on a hooping board. The hooping member in FIG. 14 has a single mounting arm 11. The transferability of the bracket mechanism 700 allows the retaining mechanism 200 to be used on hooping members that have different mounting arm configurations. Any of the other previously mentioned movable retaining mechanisms may be used on the transferable bracket mechanism 700.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

We claim:

1. An embroidery hoop retaining mechanism for use with a hoop alignment apparatus to retain a magnetic-type first hooping member while an item to be embroidered is aligned with and secured between the first and a second hooping member, the retaining mechanism comprising:

a retaining member slidably coupled to the hoop alignment apparatus, the retaining member having an engageable edge;

whereby the retaining member further comprising a biasing member for biasing the retaining member in a first direction whereby the engageable edge retains the first hooping member in the hoop alignment apparatus; and whereby the first hooping member is released from the hoop alignment apparatus when the retaining member is moved in a second direction such that the engageable edge no longer retains the first hooping member.

2. The embroidery hoop retaining mechanism of claim 1 further comprising a second retaining member coupled to the hoop alignment apparatus.

3. The embroidery hoop retaining mechanism of claim 2 wherein the second retaining member is stationary relative to the hoop alignment apparatus.

4. The embroidery hoop retaining mechanism of claim 2 wherein the second retaining member is slidable relative to the hoop alignment apparatus.

5. The embroidery hoop retaining mechanism of claim 1 wherein the retaining member further comprises at least one slot, at least one upstanding pin is formed on the hoop alignment apparatus and the pin is received within the slot.

6. The embroidery hoop retaining mechanism of claim 5 wherein the slot is U-shaped.

7. The embroidery hoop retaining mechanism of claim 6 wherein one side of the U-shaped slot is shorter than the other allowing the retaining member to be kept in a disengaged position.

8. The embroidery hoop retaining mechanism of claim 1 wherein the retaining member further comprises a chamfered edge and the second hooping member further comprises a chamfered edge, the respective chamfered edges engaging with one another during the mating of the first and second hooping members thereby biasing the retaining member in the second direction and releasing the first hooping member from the hoop alignment apparatus.

9. The embroidery hoop retaining mechanism of claim 1 wherein the biasing mechanism comprises first and second magnets, the first magnet coupled to the hoop alignment apparatus and the second magnet coupled to the retaining member.

10. The embroidery hoop retaining mechanism of claim 1 wherein the biasing mechanism comprises a spring, the spring extending between the hoop alignment apparatus and the retaining member.

11. The embroidery hoop retaining mechanism of claim 1 wherein the retaining member may be moved in the second direction and held in a non-retaining position.

12. The embroidery hoop retaining mechanism of claim 2 wherein the first retaining member and the second retaining member are located on substantially opposing sides of the hoop alignment apparatus.

13. An embroidery hoop retaining mechanism for use with an embroidery hooping device to retain a magnetic-type first hooping member in a hoop alignment apparatus until an item to be embroidered is aligned with and secured between the first hooping member and a second hooping member, the retaining mechanism comprising:

a movable retaining member coupled to the embroidery hooping device, the movable retaining member being moveable between a first position whereby the first hooping member is retained in the hoop alignment apparatus and a second position whereby the first hooping member is not retained in the hoop alignment apparatus.

14. The embroidery hoop retaining mechanism of claim 13 further comprising a stationary retaining member, the stationary retaining member being coupled to the embroidery hooping device and positioned to retain the first hooping member in the hoop alignment apparatus until the movable retaining member is placed in said second position and the first hooping member is removed from the hoop alignment apparatus.

15. The embroidery hoop retaining device of claim 14 whereby the movable retaining member and the stationary retaining member are coupled to substantially opposed sides of the embroidery hooping device.

16. The embroidery hoop retaining device of claim 13 further comprising a biasing mechanism for biasing the retaining member in a first direction whereby the retaining member retains the first hooping member to the embroidery hooping device.

17. The embroidery hoop retaining mechanism of claim 16 wherein the biasing mechanism comprises first and second magnets, the first magnet coupled to the embroidery hooping device and the second magnet coupled to the retaining member.

18. The embroidery hoop retaining mechanism of claim 16 wherein the biasing mechanism comprises a spring, the spring extending between the embroidery hooping device and the retaining member.

19. The embroidery hoop retaining mechanism of claim 13 wherein the retaining member may be temporarily biased in a non-retaining position.

* * * * *